US008342099B2

(12) United States Patent
Delhaye

(10) Patent No.: US 8,342,099 B2
(45) Date of Patent: Jan. 1, 2013

(54) MARKING PAINT BALL AND METHOD FOR MAKING SAME

(76) Inventor: David Delhaye, Alsting (FR)

( * ) Notice: Subject to any disclaimer, the term of this patent is extended or adjusted under 35 U.S.C. 154(b) by 1 day.

(21) Appl. No.: 12/679,359

(22) PCT Filed: Sep. 18, 2008

(86) PCT No.: PCT/FR2008/001310

§ 371 (c)(1),
(2), (4) Date: Jun. 21, 2010

(87) PCT Pub. No.: WO2009/074732

PCT Pub. Date: Jun. 18, 2009

(65) Prior Publication Data

US 2010/0258024 A1 Oct. 14, 2010

(30) Foreign Application Priority Data

Sep. 21, 2007 (FR) ..... 07 57747
Jun. 27, 2008 (FR) ..... 08 54309

(51) Int. Cl.
*F42B 12/40* (2006.01)
*B01J 13/02* (2006.01)

(52) U.S. Cl. ..... 102/513; 102/502; 86/1.1; 264/4.1

(58) Field of Classification Search ..... 102/513, 102/502; 264/4.1; 86/54, 1.1
See application file for complete search history.

(56) References Cited

U.S. PATENT DOCUMENTS

| | | | | |
|---|---|---|---|---|
| 5,448,951 | A | 9/1995 | Olson | |
| 5,639,526 | A | 6/1997 | Kotsiopoulos et al. | |
| 7,905,181 | B2 * | 3/2011 | Ciesiun et al. | 102/513 |
| 2002/0134055 | A1 | 9/2002 | Martinez, Jr. | |
| 2005/0217527 | A1 * | 10/2005 | Ciesiun | 102/502 |
| 2006/0005732 | A1 | 1/2006 | Forster | |
| 2006/0288898 | A1 | 12/2006 | Byun | |
| 2008/0217812 | A1 * | 9/2008 | Perrone | 264/241 |

FOREIGN PATENT DOCUMENTS

| | | | |
|---|---|---|---|
| EP | 0609298 | B1 | 8/1994 |
| WO | 2008094195 | A2 | 8/2008 |

* cited by examiner

*Primary Examiner* — James Bergin
(74) *Attorney, Agent, or Firm* — Bachman & LaPointe, P.C.

(57) ABSTRACT

A marking paint ball includes a shell made of non-water-soluble polymer material and having a substantially spherical shape. A marking paint composition is contained in the shell. The shell is made of an oxo-biodegradable material. A method for making such a ball is disclosed.

15 Claims, 1 Drawing Sheet

MARKING PAINT BALL AND METHOD FOR MAKING SAME

BACKGROUND (1) Field of the Invention

The invention relates to a marking paint ball and the method for making same.

(2) Prior Art

For military or police practice, or sports or leisure activities (particularly "Paintball"), compressed gas guns and marking paint balls are used.

The term marking paint ball refers, according to the present invention, to a capsule generally having a spherical shape, comprising a shell and a marking paint composition contained in said shell.

In this context, the nature of the constituent material of the shell and the dimensional characteristics thereof (particularly the thickness) must be such that the impact generated by a ball on a target causes the bursting of the shell and the dispersion of the marking paint composition on the target, indicating that said target has been hit.

At the present time, such a ball is produced with a gelatin shell according to a known method conventionally used for the production of medicinal products. This method comprises the formation by means of thermoforming of two hemispheres, which are assembled together, whereas the marking composition is introduced into the cavity defined by the two hemispheres.

However, this ball involves numerous problems associated with the nature of the shell.

Indeed, given that gelatin is of animal origin, the preparation thereof is difficult and it is difficult to obtain a consistent and reproducible composition. Furthermore, the production of gelatin balls must be performed under controlled atmospheric conditions due to the high sensitivity of gelatin to humidity and temperature. This is generally conveyed as follows: from a certain humidity level, gelatin softens, whereas at high temperatures, it tends to dry. Moreover, in the event of freezing, the water contained in gelatin crystallizes, resulting in the gelatin losing some of the mechanical properties thereof.

The production of gelatin balls generally comprises a hemisphere thermoforming step, generally followed by a drying step for a relatively long period, typically between one and a plurality of days.

Furthermore, with respect to the packaging of said balls once produced, the packaging must be hermetic, for example in a sealed (sometimes in a vacuum) wrapper, particularly due to the high sensitivity of gelatin to humidity and temperature conditions.

Moreover, depending on the environment of said balls during the use thereof, the mechanical properties thereof, particularly the burstability thereof following the impact on the target, and the dimensions thereof may vary, rendering same imprecise, or even unusable, such that it becomes difficult to control the life cycle thereof. The term ball having a controlled life cycle refers, according to the present invention, to a ball having a predetermined life cycle from the production thereof to the bio-assimilation thereof, and wherein the mechanical properties are controlled.

Finally, the sensitivity of gelatin to humidity requires the use of non-water-based paint compositions based on solvents such as ethylene-glycol, polyethylene-glycol or polypropylene-glycol. These non-water-based paint compositions are generally in the form of viscous gels and contain solvents which are absolutely not environmentally friendly.

To solve the abovementioned problems associated with the use of gelatin in the production of the ball shell, those skilled in the art have sought another material not involving the drawbacks of gelatin.

In this way, the European patent application EP 0 609 298 discloses a marking paint ball wherein the shell is made of polystyrene with molecular lines oriented along circumferential lines between two poles. These lines are weakened, which is favorable for the bursting of the ball following the impact thereof on a target. The ball is produced by assembling two hemispheres by means of pressurized injection, followed by bonding or sealing. While such a ball may do away with the stability problems usually encountered by balls wherein the shells are made of gelatin, the production thereof remains costly as it makes use of a pressurized injection technique and requires the handling of the hemispheres prior to the assembly thereof.

SUMMARY OF THE INVENTION

Moreover, contrary to the assertion in European patent application EP 0 609 298, polystyrene is not biodegradable, but merely fragmentable.

The term biodegradable substance or product refers, according to the present invention, to a product which is biological degradable outdoors by means of the combined actions of oxidative abiotic degradation, followed by bio-assimilation via the action of micro-organisms.

The term fragmentable refers, according to the present invention, to a substance which is fragmented molecule by molecule, but which is not chemically transformed. In this way, in the case of polystyrene, after the degradation of the substances, further polystyrene molecules are obtained.

Therefore, one of the aims of the invention is to propose a marking paint ball wherein the life cycle is controlled, which has a low sensitivity to atmospheric conditions, is simple to produce and is genuinely environmentally friendly, both in terms of the container (i.e. the shells) and the content, i.e. the marking paint composition which may be water-based.

The term genuinely environmentally friendly product or substance refers, according to the present invention to a biologically degradable product or substance not generating toxic residue.

Indeed, the applicant surprisingly discovered that a non-water-soluble oxo-biodegradable polymer material may be used to produce marking paint ball shells, since this material has the same mechanical properties as gelatin.

The term oxo-biodegradable polymer material refers, according to the present invention, to a polymer material than can be biologically degraded outdoors, after having previously undergone abiotic oxidative degradation under the combined effect of heat and UV radiation, by means of carbon-hydrogen bond oxidation inducing a reduction in the molecular weight of the material. The material oxidized in the presence of microorganisms is then converted to $CO_2$, water and a non-sterile biomass, without generating toxic residue.

Furthermore, the oxo-biodegradable polymer material enables the use of water-based paints which are much more environmentally friendly than the solvent-based marking paints conventionally used in marking paint balls.

Therefore, the present invention relates to a marking paint ball comprising:

- a shell made of non-water-soluble polymer material and having a substantially spherical shape, and
- a marking paint composition contained in said shell.

According to the invention, the shell consists of an oxo-biodegradable polymer material.

The advantage of such a ball is that it has equivalent properties to those of gelatin when used for the production of marking paint balls (particularly for "paint-ball" applications). The mechanical properties and dimensional characteristics of said ball remain consistent irrespective of the hygrometric conditions encountered during the packaging or use of the ball.

Furthermore, due to the oxo-biodegradable nature of the shell, the balls are rendered compatible with use outdoors where, if they are abandoned, they are degraded after a predetermined time, without forming hazardous compounds.

Advantageously, the oxo-biodegradable polymer material forming the shell is an oxo-biodegradable thermoplastic polymer, preferably selected from oxo-biodegradable polyolefins.

Examples of oxo-biodegradable polyolefins suitable for use in the balls according to the invention particularly include oxo-biodegradable polyethylenes such as those described in the scientific publications "Acquired biodegradability of polyethylenes containing pro-oxidant additives", in Polymer Degradation and Stability 91 (2006) 1495-1503, by M. Koutny, M. Sancelme, C. Dabin, N. Pichon, A. M. Delort, and J Lemaire (high-density and low-density polyethylenes) and "Biodegradation of thermally-oxidized, fragmented low-density polyethylenes", in Polymer Degradation and Stability 81 (2003) 341-351, by E. Chiellini, A. Corti and G. Swift (low-density polyethylenes (LDPE) only).

The oxo-biodegradable polymer material forming the shell advantageously comprises a synthetic polymer and at least one transition metal salt.

The synthetic polymer of the oxo-biodegradable polymer material used in the balls according to the invention is advantageously a thermoplastic polymer, preferably a polyolefin.

Examples of polyolefins suitable for use in the polymer material according to the invention particularly include low-density polyethylene (LDPE), high-density polyethylene (HDPE), and polypropylenes.

Examples of transition metals used in the transition metal salts contained in the oxo-biodegradable polymer materials particularly include iron, manganese, and cobalt.

Advantageously, the shell of the balls according to the invention has a thickness between 80 and 300 μm, preferably between 80 and 120 μm. Such dimensional characteristics optimize the bursting of the ball only following the impact thereof on a target.

Advantageously, the marking paint composition contained in the ball according to the invention is water-based.

Preferably, the marking paint composition contained in the ball according to the invention contains 40 to 60% water, 0 to 5% coloring substances and 20 to 40% binder.

Such a water-based composition offers advantages with respect to the environmental quality thereof and in terms of costs, due to higher aqueous saturation.

According to an improvement of the present invention, the marking paint composition further contains up to 5% sodium chloride, to prevent the paint composition from setting in negative temperatures.

The ball according to the present invention is also suitable for production by means of thermoforming as for balls wherein the shell is made of gelatin, but with a considerably simplified method requiring no drying step.

In this way, the present invention also relates to a method for producing a marking paint ball comprising a shell containing a marking paint composition, comprising the following steps:

providing two films of similar material;

arranging said films in an encapsulation unit comprising two molding drums, each comprising a cylinder wherein a plurality of hemispherical cavities are formed, said drums being arranged such that the axes thereof are parallel and the joined cylinders and the films feeding continuously in the encapsulation unit so as to arrive tangentially on the drum cylinders;

transforming the films into capsule portions having a substantial hemispherical shape by means of counter-rotating rotation of the molding drum cylinders, and the simultaneous introduction of the marking paint composition into said capsule portions;

closing said capsule portions to form said shells filled with marking paint composition;

said method being characterized in that the films are made of oxo-biodegradable non-water-soluble polymer material, and in that, prior to the arrival of the films on the drum cylinders, the films are heated to a temperature between 90 and 140° C.

The method according to the invention is simplified in relation to the existing methods conventionally used for producing gelatin balls by removing the drying step. This step is rendered unnecessary in that the oxo-biodegradable polyolefin has, from the cooling following the thermoforming, the mechanical properties required for use of the ball in "paint-ball" applications.

Advantageously, the films are made of oxo-biodegradable polyolefin, and the heating temperature of said films, prior to the arrival thereof on the drum cylinders, is between 100 and 120° C.

Preferably, sheets made of monoaxially or biaxially-oriented polyolefin are used as films, making it possible to obtain a tendency of the shell to contract following the cooling thereof, which may result in pressure prestress on the ball. This prestress may give rise to a fragile rupture of the ball following the impact thereof.

Advantageously, the oxo-biodegradable polymer material is a multi-layer sheet comprising a superposition of a plurality of single layers obtained by means of coextrusion or rolling.

BRIEF DESCRIPTION OF THE DRAWINGS

The invention will be understood more clearly and further features and advantages will emerge on reading the description hereinafter, with reference to the appended figures wherein.

DETAILED DESCRIPTION OF THE PREFERRED EMBODIMENT(S)

Figure 1:
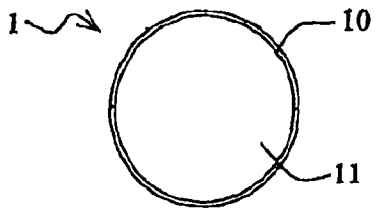
FIG. 1 is a sectional view of a ball according to the invention.

FIG. 1 represents a marking paint ball 1 according to the invention, comprising a shell 10 having a spherical shape and containing a marking paint composition 11.

Figure 2:
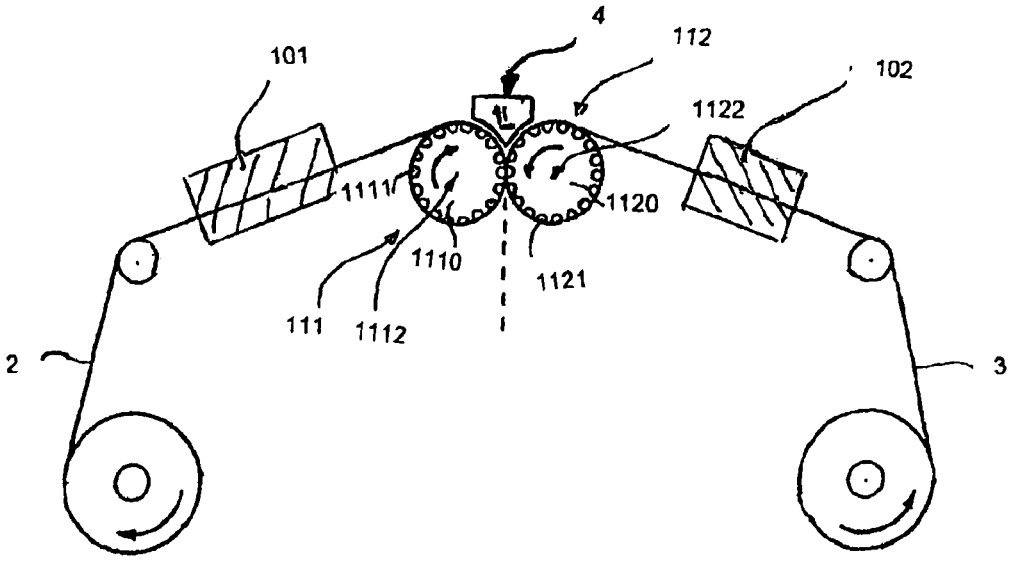
FIG. 2 is a sectional view of a device used for the implementation of the method for producing the balls according to the invention.

To produce balls 1 according to the invention, a device 100 consisting of an encapsulation unit suitable for the implementation of the method according to the invention is used, which is represented in FIG. 2. In said device 100, two oxo-biodegradable polyolefin films 2, 3 are positioned in rolls on the device 100. Each film 2, 3 is unwound and enters an oven 101, 102 so as to be heated therein to a temperature between 100 and 120° C. Each film 2, then arrives tangentially on a molding drum 111, 112 comprising a cylinder 1110, 1120 and hemispherical cavities 1111, 1112, each connected to a vacuum source (not shown in FIG. 2). The two drums 111, 112 are arranged next to each other with parallel axes 1112, 1122, and the drums 111, 112 are joined. A prism 4 filled with marking paint composition 11 is arranged immediately above the drums 111, 112, so as to coat same on approximately one quarter of the respective surface area thereof. The prism 4 is provided, at the lower portion thereof, with a plurality of orifices suitable for injecting marking paint composition 11 between the two films 2 and 3 when they are positioned on the respective drums 111, 112 thereof.

When the films 2, 3 reach the drums 111, 112 at the cylinders 1110, 1120, they are drawn into each cavity 1111, 1121 and adopt the hemispherical shape thereof. Due to the counter-rotating rotation of the cylinders 1110, 1120, the two films 2, 3 are then joined and the marking paint composition 11 is injected simultaneously. The hemispherical portions, filled with the marking paint composition 11, are sealed in pairs to form the balls 1 according to the invention.

The invention claimed is:

1. Marking paint ball comprising:

a shell made of non-water-soluble polymer material and having a substantially spherical shape, and a marking paint composition contained in said shell, wherein the shell consists of an oxo-biodegradable polymer material which when oxidized in the presence of microorganisms is converted to carbon dioxide, water and a non-sterile biomass without generating toxic residues.

2. Ball according to claim 1, wherein the oxo-biodegradable polymer material is an oxo-biodegradable thermoplastic polymer.

3. Ball according to claim 2, wherein the oxo-biodegradable thermoplastic polymer is an oxo-biodegradable polyolefin.

4. Ball according to claim 3, wherein the oxo-biodegradable polyolefin is an oxo-biodegradable polyethylene.

5. Ball according to claim 1, wherein the oxo-biodegradable polymer material comprises a synthetic polymer and at least one transition metal salt.

6. Ball according to claim 1, wherein the shell has a thickness between 80 and 300 μm.

7. Ball according to claim 6, wherein the shell thickness is between 80 and 120 μm.

8. Ball according to claim 1, wherein the marking paint composition is water-based.

9. Ball according to claim 8, wherein the marking paint composition contains 40 to 60% water, 0 to 5% coloring substances and 20 to 40% binder.

10. Ball according to claim 9, wherein the marking paint further contains up to 5% sodium chloride.

11. Method for producing a marking paint ball comprising a shell containing a marking paint composition, comprising the following steps:

providing two films of similar material;

arranging said films in an encapsulation unit comprising two molding drums, each comprising a drum cylinder wherein a plurality of hemispherical cavities are formed, said molding drums being arranged such that axes thereof are parallel and the drum cylinders are joined, said films feeding continuously in the encapsulation unit so as to arrive tangentially on the drum cylinders;

transforming the films into capsule portions having a substantially hemispherical shape by means of counter-rotating rotation of the molding drum cylinders, and the simultaneous introduction of the marking paint composition into said capsule portions; and closing said capsule portions to form said shells filled with marking paint composition; and the films being made of oxo-biodegradable non-water-soluble polymer material which when oxidized in the presence of microorganisms is converted to carbon dioxide, water and a non-sterile biomass without generating toxic residues, and prior to the arrival of the films on the drum cylinders, said films are heated to a temperature between 90 and 140° C.

12. Method according to claim 11, wherein said films are made of oxo-biodegradable polyolefin, and the heating temperature of said films, prior to the arrival thereof on the drum cylinders, is between 100 and 120° C.

13. Method according to claim 12, wherein said films are sheets made of monoaxially or biaxially-oriented polyolefin.

14. Method according to claim 11, wherein the method is devoid of any drying process following the thermoforming of the hemispheres.

15. Method according to claim 11, wherein the sheet of polymer material is a multi-layer sheet comprising a superposition of a plurality of single layers obtained by means of coextrusion or rolling.

* * * * *